US005237976A

United States Patent [19]

Lawrence et al.

[11] Patent Number: 5,237,976

[45] Date of Patent: Aug. 24, 1993

[54] ENGINE COMBUSTION SYSTEM

[75] Inventors: Keith E. Lawrence, Peoria; Tsu P. Shyu, Dunlap, both of Ill.

[73] Assignee: Caterpillar Inc., Peoria, Ill.

[21] Appl. No.: 993,527

[22] Filed: Dec. 17, 1992

Related U.S. Application Data

[63] Continuation of Ser. No. 779,777, Oct. 21, 1991, abandoned.

[51] Int. Cl.[5] ..... F02M 37/04

[52] U.S. Cl. ..... 123/508; 123/90.12; 123/90.13

[58] Field of Search ..... 123/507, 508, 509, 90.11, 123/90.12, 90.13; 417/479, 480

[56] References Cited

U.S. PATENT DOCUMENTS

| | | | |
|---|---|---|---|
| 2,955,582 | 10/1960 | Taylor | 123/508 |
| 3,587,547 | 6/1971 | Hussey et al. | 123/139 |
| 4,000,756 | 1/1977 | Ule | 123/90.12 |
| 4,009,695 | 3/1977 | Ule | 123/90.13 |
| 4,206,728 | 6/1980 | Trenne | 123/90.11 |
| 4,306,680 | 12/1981 | Smith | 417/380 |
| 4,527,738 | 7/1985 | Martin | 239/90 |
| 4,602,604 | 7/1986 | Kauer | 123/508 |
| 4,784,102 | 11/1988 | Igashira et al. | 123/447 |
| 4,794,890 | 1/1989 | Richeson, Jr. | 123/90.11 |
| 4,995,351 | 2/1991 | Ohubo | 123/90.11 |

FOREIGN PATENT DOCUMENTS

| | | | |
|---|---|---|---|
| 0002405 | 4/1986 | European Pat. Off. | 123/90.12 |
| 1569638 | 6/1980 | United Kingdom . | |
| 2107393 | 4/1983 | United Kingdom | 123/90.12 |
| 2213873A | 8/1989 | United Kingdom . | |

*Primary Examiner*—Carl S. Miller
*Attorney, Agent, or Firm*—J. Wesley Blumenshine

[57] ABSTRACT

An arrangement in a single housing positioned over a piston cylinder of an engine of independently operable "on-off" valve actuators, "on-off" valves, hydraulic fluid headers and rails, engine intake and exhaust valves, and unit fuel injector.

9 Claims, 4 Drawing Sheets

ENGINE COMBUSTION SYSTEM

This is a continuation of Ser. No. 07/779,777, filed Oct. 19, 1991, now abandoned.

TECHNICAL FIELD

The present invention relates to actuation of engine combustion chamber valves and engine unit fuel injectors, and more particularly, to the use and arrangement of multiple unit actuators for independently controlling the actuation of unit fuel injectors, intake valves, and exhaust valves.

BACKGROUND ART

In conventional engines, engine combustion chamber valve opening and closing events are sequenced and driven by a cam shaft and conventional valve train components. Such valves are almost universally of the poppet-type. Such poppet valves are spring loaded toward a closed position and opened against the spring bias by a cam on a rotating cam shaft. The cam shaft is synchronized with the engine crankshaft to achieve valve opening and closing at preferred times in the engine cycle. This fixed timing is a compromise between the timing best suited for high engine speed and the timing best suited for lower speeds or engine idling speed.

Fuel for such engines is usually mixed with air, commonly in a carburetor, and provided to the cylinder through an intake valve or through a cam driven unit fuel injector. An example of a cam driven unit fuel injector is found in U.S. Pat. No. 4,527,738.

The prior art has recognized numerous advantages which might be achieved by replacing such cam actuated valve and unit injector arrangements with some other type mechanism for controlling the valve opening and closing events and the fuel injecting events as a function of engine speed as well as engine crankshaft position. Attempts to replace the cam for independently controlling the injection events of the unit fuel injector or the opening and closing events of an engine valve have included solenoids, colenoids, piezoelectric motors, voice coils, and high-force electromagnets. An exemplary unit fuel injector actuated by a piezoelectric motor is disclosed in U.S. Pat. No. 4,784,102. An exemplary engine valve actuated by a bi-stable electromechanical transducer is disclosed in U.S. Pat. No. 4,794,890.

However, no one has yet combined independently operable actuators into a system wherein a number of actuators are used to individually and independently control exhaust valves' opening and closing events, intake valves' opening and closing events, and unit fuel injector injection, and this is an object of the present invention.

Such an arrangement of independently operable "on-off" valve actuators, "on-off" valves, hydraulic fluid headers and rails, engine valves, and unit fuel injector provides an efficient and practical means for independently controlling the opening and closing events of the engine valves and the fuel injection of the unit fuel injector.

DISCLOSURE OF THE INVENTION

The present invention relates to the use and arrangement of multiple valve actuators to actuate engine exhaust and intake valve opening and closing events and fuel injection Such a system includes first, second and third "on-off" valve actuators, "on-off" valves, and "on-off" valve stops, a high pressure fluid header in communication with each "on-off" valve, and hydraulic rails extending from each "on-off" valve to communicate high pressure fluid from the high pressure fluid header via the "on-off" valve to the engine intake valves, exhaust valve and unit fuel injector, as the case may be.

A preferred "on-off" valve actuator is a piezoelectric motor whose linear expansion under electrical excitation is hydraulically amplified into linear displacement of the "on-off" valve Positioning of the "on-off" valve by the piezoelectric motor controls the selective communication of high pressure fluid to the engine valves and unit fuel injector. The piezoelectric motors are timely actuated based upon the control logic of a microprocessor which receives signals from engine operating conditions sensors.

BEST MODE FOR CARRYING OUT THE INVENTION

Figure 1:
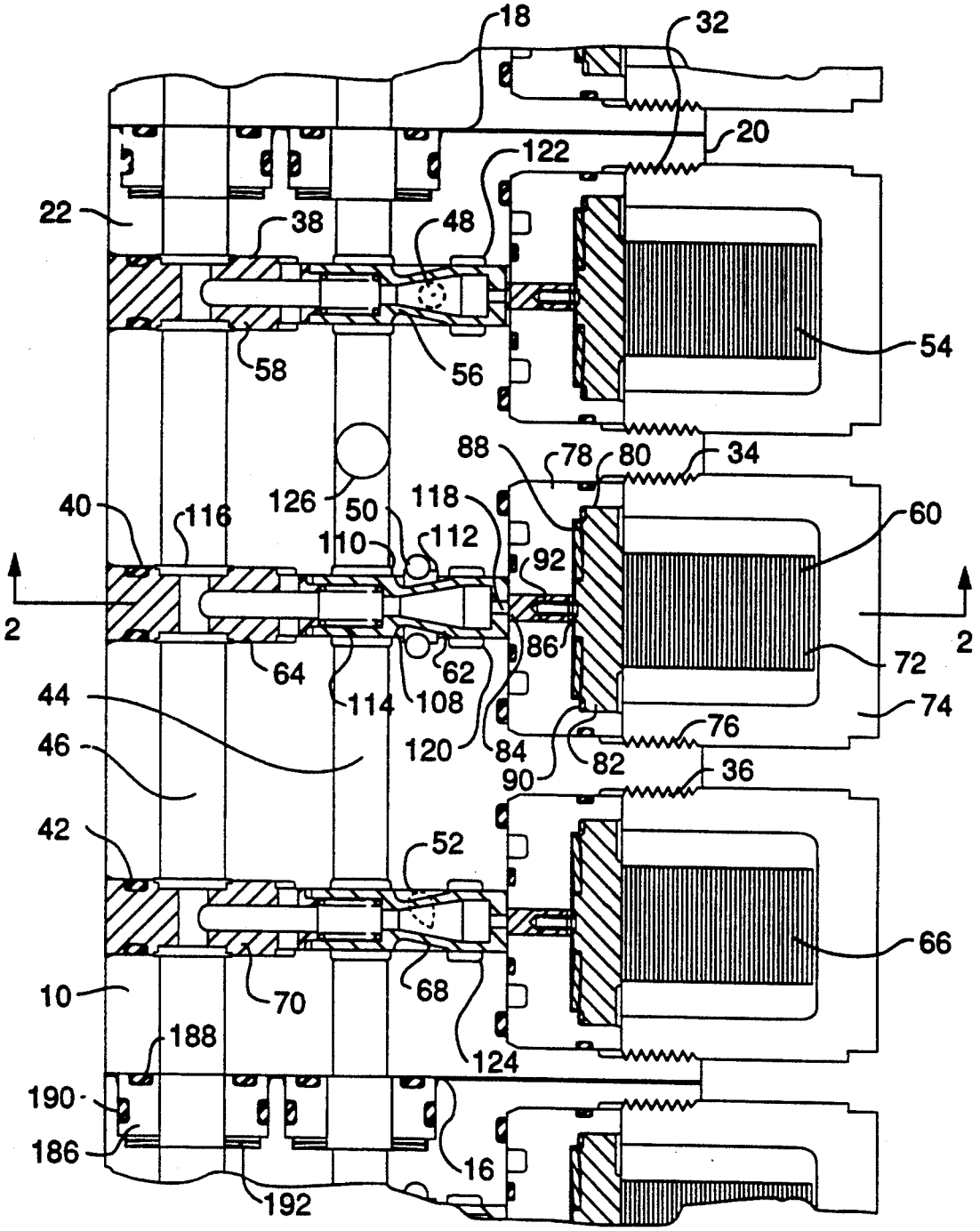
FIG. 1 is a top cross-sectional view of a housing and of an arrangement of the present invention of multiple "on-off" valves and "on-off" valve actuators.

Basically, the present invention relates to the use and arrangement of multiple valve actuators to actuate exhaust and intake valve opening and closing events and fuel injection.

Referring now to the drawings, in the preferred embodiment of the present invention, all the features of the present invention are housed in a single housing i0 having a top 12, a bottom I4, a left side 16, a right side 18, a front 20, and a back 22. The housing 10 is positioned over a unit injector assembly 24 and engine valve assemblies which in turn are positioned over the combustion chamber of a piston cylinder of the engine. Each housing 10 herein described is positioned over a single piston cylinder of an engine and actuates the intake valves 28, exhaust valve 30 and unit fuel injector 24 for that cylinder. As later described, for multiple cylinder engines, a number of housings can be positioned side-by-side and may use common hydraulic headers. With this background of the general layout of the combustion system of the present invention, the system will now be explained in greater detail.

Looking now at FIG. 1, in the front 20 of the housing 10 near the top 12, are three threaded bores 32,34,36 parallel to each other, each for receiving a valve actuator. Extending from the center of each bore 32,34,36 to the back of the housing 10 are three smaller bores 38,40,42, each for receiving an "on-off" valve and an "on-off" valve stop. Running from the left side 16 to right side 18 of the housing 10 in the same elevational plane as the small bores 38,40,42 are a high pressure hydraulic fluid header 44 and a low or no pressure hydraulic fluid drain header 46. The headers 44 and 46 may in other embodiments be external to the housing 10. Extending from each "on-off" valve bore to the intake valves 28, exhaust valves 30, and unit fuel injector 24, as the case may be, are fluid rails 48,50,52.

A first valve actuator 54, a first "on-off" valve 56 and a first valve stop 58 are provided for actuating three intake valves 28. A second valve actuator 60, a second "on-off" valve 62, and a second valve stop 64 are provided for actuating a unit fuel injector 24. A third valve actuator 66, a third "on-off" valve 68 and a third valve stop 70 are provided for actuating an exhaust valve 30. Because each of the valve actuators and "on-off" valves are essentially of the same design and essentially function in the same manner, only the second will be described in detail.

In the preferred embodiment, the valve actuator 62 is a piezoelectric motor 72, although it could be one of any number of types such as solenoids, voice coils, or linear displaceable electromagnetic assemblies. The piezoelectric motor 72, which is well-known in the art, expands linearly upon electrical excitation and contracts when the electrical excitation is ended. The motor 72 is housed in a piezo-housing 74 having external threads 76. The piezo-housing 74 is threaded into the bore 34. Adjacent the piezo-housing 74 and within the bore 34 is a piston housing 78 having a stepped cavity 80 in which are positioned a driver piston 82, an amplifier piston 84, and a fluid chamber therebetween 86. The driver piston 82 is biased toward its first position adjacent the motor by a belleville spring 88. An o-ring seal 90 seals the hydraulic fluid in the fluid chamber 86 from the piezo-housing 74. The amplifier piston 84 has a central bore 91, the volume of which forms part of the fluid chamber 86. A compression spring 92 between the driver piston 82 and the amplifier piston 84 preloads the amplifier piston 84 against the "on-off" valve 62.

The piezoelectric motor 72 can generate high force in the linear direction, however, its linear expansion is much less than the required linear displacement of the "on-off" valve 62. Therefore, the driver piston 82, amplifier piston 84 and fluid chamber 86 are provided to translate and amplify linear displacement of the motor 72 into linear displacement of the "on-off" valve 62 in the following manner. The amplifier piston 84 is sized much smaller than the driver piston 82 because the hydraulic amplification ratio of the linear displacement of the driver piston 82 as it relates to the linear displacement of the amplifier piston 84 is inversely proportional to the surface area ratio of the driver piston 82 to the amplifier piston 84. Thus, small linear displacement of the motor 72 is amplified to produce significantly greater linear displacement of the amplifier piston 84 and "on-off" valve 62.

Figure 2:
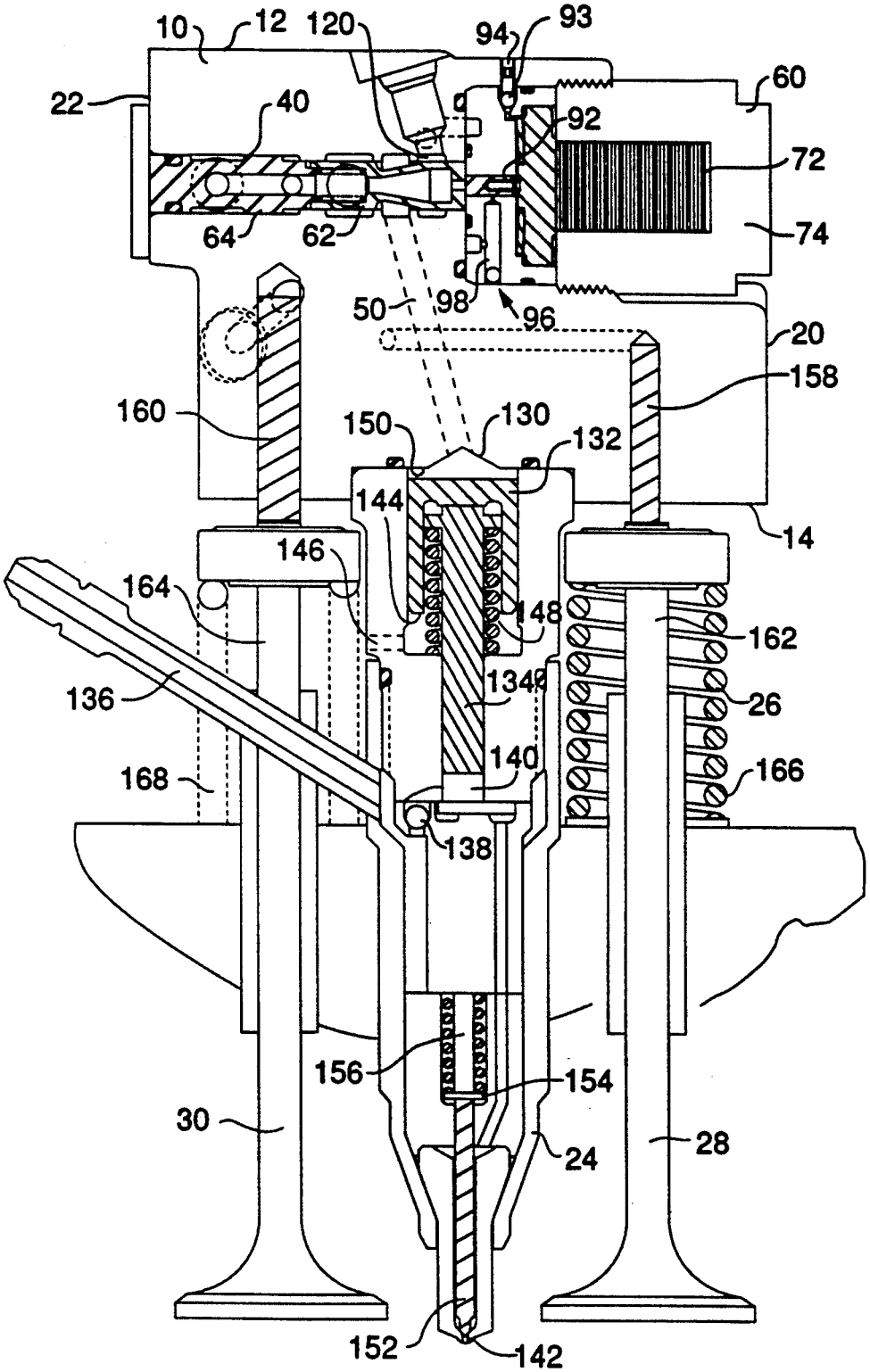
FIG. 2 is a left-side cross-sectional elevational view through the line 2—2 of FIG. 1.

Looking now at FIG. 2, bleed check ball 93 and set screw 94 are provided to bleed air out of the fluid chamber 86, thus keeping the hydraulic fluid as incompressible as possible. The volume of the fluid chamber is minimized to stiffen hydraulic amplification.

Figure 3:
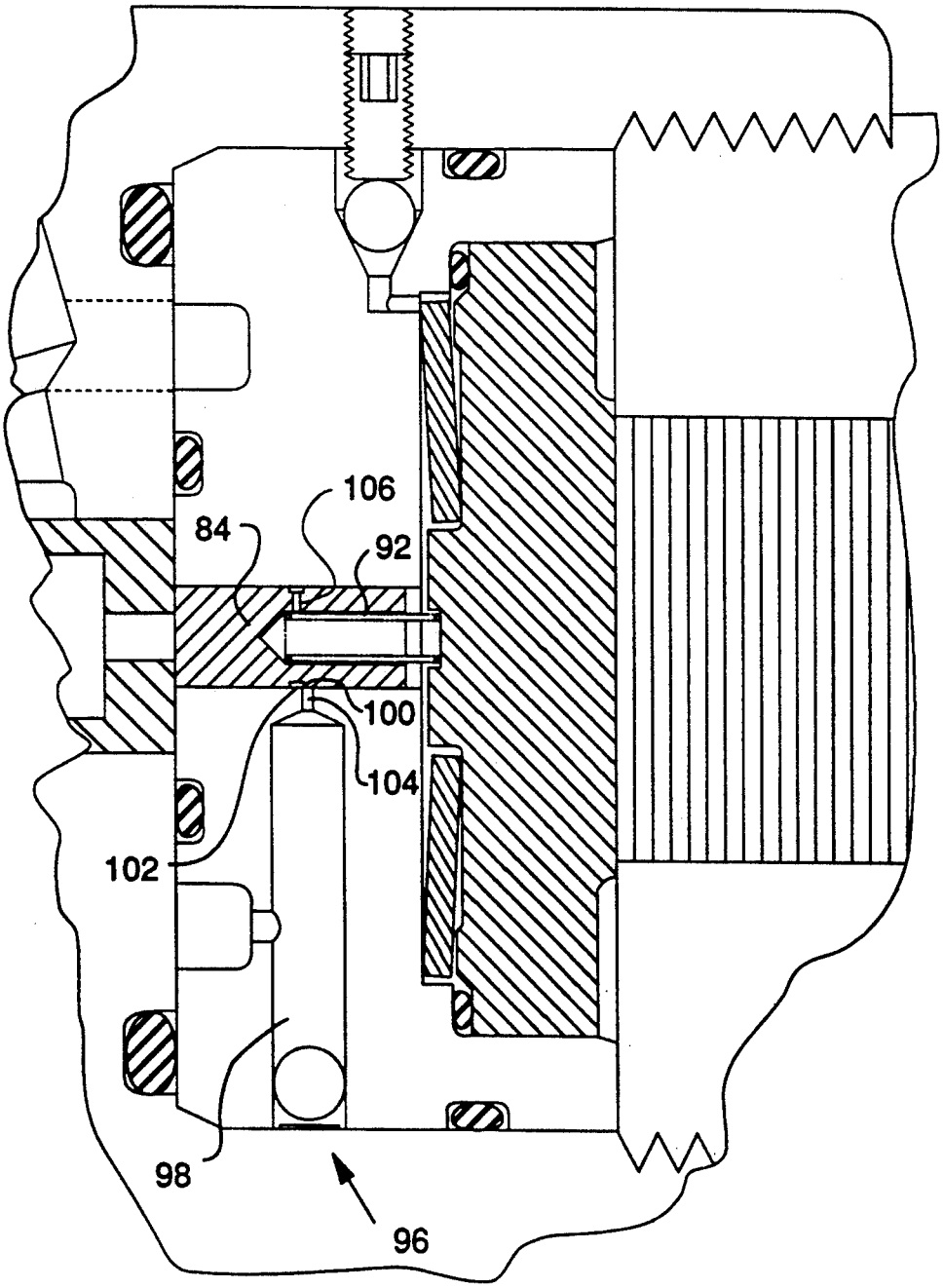
FIG. 3 is an enlarged view of the fluid chamber and surrounding elements shown in FIG. 2.

Looking now at FIG. 3, which is an enlarged view of the fluid chamber 86 and surrounding structures, a pressure equalization valve 96 which is in constant communication with low pressure fluid is provided to offset leakage losses and keep the fluid chamber 86 resupplied with hydraulic fluid and also to drain excess fluid from the fluid chamber 86 which thereby offsets thermal expansion of the motor 72 or hydraulic working fluid. If excess fluid is not drained, the driver piston 82 may be prevented from returning to its first position subsequently preventing the amplifier piston 84 and the "on-off" valve 62 from returning to their first positions. The pressure equalization valve 96 is comprised of the low pressure fluid flow passage 98, into or out of which hydraulic fluid is allowed to flow, and the amplifier piston's metering edge 100 of annulus 102, positioned to open a 0.1 mm fluid gap across the small inlet opening 104 of the flow passage 98 when the amplifier piston 84 is at its first position. When the amplifier piston 84 is displaced 0.1 mm, the metering edge 100 closes off the small inlet opening 104, thus closing the pressure equalization valve 96. The pressure equalization valve 96 includes an orifice 106 in the amplifier piston 84 which communicates the flow passage 98 with the fluid chamber 86 when the valve 96 is open.

Looking again at FIG. 1, adjacent the amplifier piston 84 is the "on-off" valve. In the preferred embodiment, the "on-off" valve 62 is a spool valve, although it could be a poppet valve or any other type valve which can selectively communicate high pressure fluid when necessary, as later described. Linear displacement of the motor 72 is amplified by the driver piston 82 and amplifier piston 84 arrangement into linear displacement of the "on-off" valve 62 in a direction from the front 20 to the back 22 of the housing 10. The "on-off" valve's 62 travel is limited to 1.1 mm by the stop 64. The "on-off" valve 62 is at its open or second position when the "on-off" valve 62 metering edge 108 is within the header 44 and not overlapped with the header annulus meterinq edqe 110, thereby allowing fluid to pass between the header 44 and the "on-off" valve 62. Opening into the "on-off" valve bore 40 at the annulus 112 is the rail 50.

When electrical excitation of the motor 72 is ended, the return spring 114 pushes the "on-off" valve 62 to its first or closed position. At the intersection of the valve stop 64 and the drain header 46 is an opening 116 in the valve stop 64. The "on-off" valve 62 is hollow and any fluid which has leaked past the amplifier piston 84 from the fluid chamber 86 or around the "on-off" valve 62 from the header 44 is drained through a central passage 118 in the valve 62, into the stop 64, and out through the opening 116 in the stop 64 into the drain header 46. In this way, the responsiveness and displacement of the valve 62 is not dependent on any hydraulic pressure forces acting haphazardly on the ends of the valve 62.

One exception to the common design of the valve arrangement is that the unit fuel injector 24 requires more hydraulic work to operate than the engine valves 28,30 and, thus, more high pressure hydraulic fluid, therefore, for the second "on-off" valve 62, high pressure fluid is channeled through an annulus 112 and into two rails 50 instead of one. Two rails are used to actuate the unit fuel injector 24 to minimize the line loss of high fluid pressure required for actuation and to hydraulically balance the flow around the valve 62. One rail could be used, however, in this housing 10, it was determined that one rail would require a bore size that was so large it would interfere with other structures or with the functioning and responsiveness of the valve 62. Alternatively, a single elongated opening could be used across the width of the annulus 112, however, such an opening is difficult to manufacture. Another exception is that because high pressure fluid recuperation is not used in the fuel injection hydraulic circuit, the second valve 62 low pressure annulus 120 is drained to atmospheric pressure. The low pressure annuluses 122,124 of the first and third spool valves 56,68 are connected through openings to an external low pressure hydraulic fluid header (not shown) to prevent and/or minimize cavitation when recuperating engine valve energy.

Intersecting the high pressure header at the threaded opening 126 and extending vertically upwards therefrom is a hydraulic reserve member 128 (not shown). The hydraulic reserve member 128 is an elongated metal casing having external threads which is screwed into the housing 10 and which has a hydraulic reserve cavity in which is positioned a compressed nitrogen gas filled rubber bladder.

Having now described the similar construction of the valve actuator and "on-off" valve assemblies, the particular construction of the rails, engine valves, and unit fuel injector will now be described with reference to FIG. 2.

Communicating high pressure fluid between the second "on-off" valve 62 and the unit fuel injector 24 for actuation of the unit fuel injector 24 are the two rails 50. The rails 50 intersect with a counter bore 130 or a cone-shaped relief to get the majority of the intensifier piston area 132 of the unit injector 24 in contact with the high pressure hydraulic fluid at the start of injection. This minimizes the response time needed to start the fuel injection process. Engine fuel is pressurized to about 20,000 psi when the intensifier piston 132 pushes on the plunger 134 to compress the fuel that has been passed from the fuel inlet 136, through the ball check valve 138 and into the trapped fuel cavity 140. The unit injector 24 uses a conventional injector nozzle 142 to atomize and spray fuel into the cylinder. The back side 144 of the intensifier piston 132 is vented to the atmosphere through the passage 146 to prevent back pressure from building up behind the intensifier piston 132 which would require additional hydraulic work to overcome. The vent is implemented with a filter or check valve (not shown) to protect the injector from contamination. Fuel from the fuel inlet I36 refills the trapped fuel cavity 140 through the ball check valve 138 when the return spring 148 pushes the intensifier piston 132 back against the stop 150. This occurs when the valve 62 is closed. The hydraulic pressure necessary to open the needle valve 152 is controlled by properly selecting the width of the spring spacer 154 and the length of the needle stop 156 components in the injector nozzle 142.

The intake valves 28 and exhaust valve 30 are actuated by opening the first and third "on-off" valves 56,68 allowing high pressure hydraulic fluid to flow into the intake valve rail 48 and the exhaust valve rail 52, respectively. Under hydraulic pressure, the plungers 158,160 push against the valve stems 162,164 to open the valves. The plunger diameters are sized to pressure balance with the valve return springs 166,168. The pressure balance occurs when the valves reach their fully opened positions and a precalculated amount of hydraulic pressure, in this case 3,000 psi, is applied to the plungers. This pressure balancing approach eliminates the need to use hard stops to limit the opening travel of the engine valves.

Figure 4:
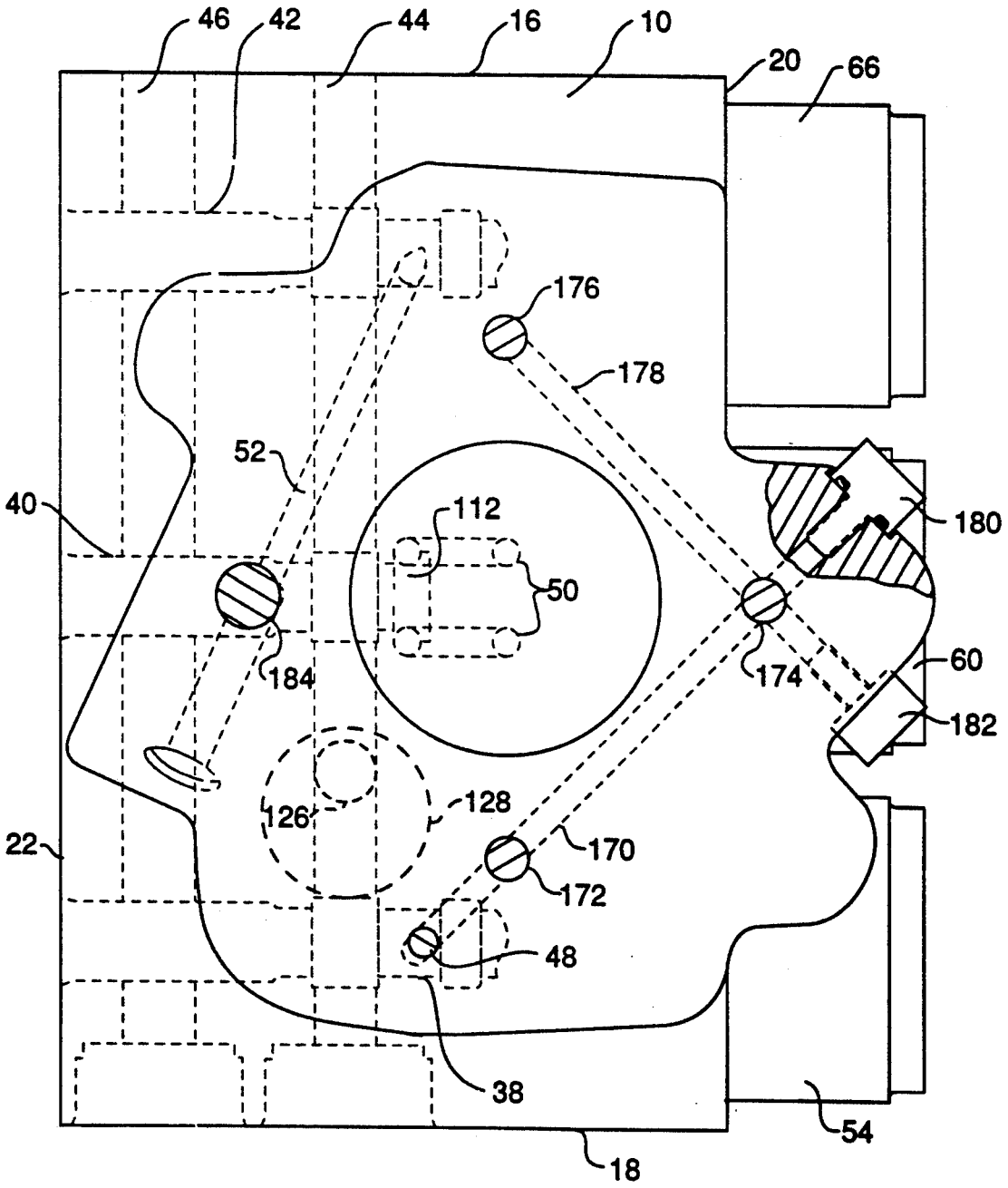
FIG. 4 is a bottom view of the housing and "on-off" valve actuators of FIG. 1 showing the hydraulic headers, rails, and "on-off" valve bores in phantom.

As shown in FIG. 4, there are three intake valves 28. In order to actuate the three intake valves, the intake valve rail 48 is comprised of two branches. The intake rail 48 is bored in the housing 10 from the bore 38 straight down to the first branch 170, which is roughly planar with the tops of the intake valve plunger bores 172,174,176. The first branch 170 is bored laterally from front 20 to back 22 and left 16 to right 18 over the second and first intake valve bores 174,172. The second branch 178 is bored laterally to intersect the first branch 170 through the second intake valve bore 174 and extend over to and intersect the third intake valve bore 176. The open ends of the branches wherefrom the branches were drilled are then plugged by plugs 180,182.

The exhaust valve rail 52 is formed at a compound angle. As used herein, the term compound angle is used to describe a rail that intersects three different planes, each at 90 degrees to the other. From the third valve bore 42, the exhaust valve rail 52 is bored at an angle in the housing 10 from bottom 41 to top 12, back 22 to front 20, and right 18 to left 16 so that the rail 52 intersects the top of the exhaust valve bore 184. The use of a compound angle exhaust valve rail makes it possible to provide the three intake and one exhaust valve arrangement in a single-piece housing 10. The opening used for drilling the exhaust valve rail 52 is then plugged (not shown).

Looking again at FIG. 1, manifold plugs 186 can be used to connect multiple housings 10 in series. When housings 10 are set in series, the high pressure fluid in the high pressure header 44 increases the effectiveness of the face seals 188 because fluid pressure acting on the differential area between the face seal 188 and the radial seal 190 creates a hydraulic force that combines with the manifold plug's belleville spring's 192 clamping load, preventing leakage. Alternatively, a single housing extending across a number of cylinders could be formed using the same principles herein described and could be attached to the block of an engine much like a conventional engine cylinder head.

Industrial Applicability

Engine sensors relay information concerning the operating conditions of the engine, for example, temperature, rpm's, load, air-fuel mixture, etc., to a microprocessor. The microprocessor uses a preprogrammed logic to process the data provided by the sensors and based upon the results of the analysis outputs a signal to an electrical source to supply current to the various piezoelectric motors. The motors are actuated independently of each other and thus the intake valves, exhaust valves and unit fuel injector are independently controlled so as to produce optimum timing events of valve opening and fuel injection for various engine operating conditions.

When a piezoelectric motor is actuated, by use of the hydraulic amplification earlier described, an "on-off" valve is displaced from its first closed position to its second open position against the force of the return spring bias. As the "on-off" valve is displaced, the metering edge of the "on-off" valve passes the metering edge of the high pressure header annulus allowing high pressure hydraulic fluid in the high pressure header to be ported through the "on-off" valve into the respective rail. The high pressure fluid then opens the engine intake or exhaust valves or actuates fuel injection, as the case may be.

Recuperation of engine valve return spring energy is beneficial to providing an efficient hydraulic alternative to a cam driven internal combustion engine. Because the piezoelectric motors and "on-off" valves have rapid switching response, hydraulic recuperation is feasible. Recuperation occurs on the return stroke of the engine valves when the "on-off" valve is "off" and low pressure fluid in contact with the plunger surface is pressurized in the decreasing volume of the cavity and rail above the plunger and then pumped back into the high pressure header when the "on-off" valve is turned "on" for a brief period to recuperate the energy in the hydraulic fluid. With proper "on-off" switching, hydraulic work can be recovered from the engine valve's kinetic energy and the valve spring's potential energy.

Other aspects, objects and advantages of this invention can be obtained from a study of the drawings, the disclosure, and the appended claims.

We claim:

1. In an engine combustion system having a plurality of combustion chambers, each combustion chamber having an intake valve, an exhaust valve and a fuel injector, the improvement comprising:

a plurality of discrete, separate control modules each being connectable to a respective one of said intake valve, exhaust valve, and fuel injector of a respective engine cylinder and connectable to one another in fluid communication, each of said control modules having a housing having three actuator cavities, three valve cavities, a high pressure major passageway, a low pressure major passageway, three high pressure intake passageways, three high pressure delivery passageways, three low pressure intake passageways and three low pressure discharge passageways;

each of said actuator cavities being adapted to receive a actuator in fluid communication with the respective valve cavity;

each of said valve cavities adapted to receive an "on-off" valve;

each of said high pressure intake passageways being in fluid communication with the high pressure major passageway and a respective valve cavity;

each of said high pressure delivery passageways being in fluid communication with a respective valve cavity and, in the installed position, a respective one of the intake valve, exhaust valve and fuel injector;

each of said low pressure intake passageways being in fluid communication with a respective one of the intake valve, exhaust valve, and fuel injector and with a respective valve cavity; and each of said low pressure discharge passageways being in fluid communication with a respective valve cavity and the low pressure major passageway.

2. An engine combustion system, as set forth in claim 1, wherein said actuator cavities and associated valve cavities are generally parallel to one another and transverse a longitudinal axis of said combustion chamber in the installed position.

3. An engine combustion system, as set forth in claim 1, wherein the housing is of unitary construction.

4. An engine combustion system, as set forth in claim 3, wherein the housing passageways and chambers are longitudinally straight and intersect one another at various angles.

5. An engine combustion system, as set forth in claim 1, wherein the housing passageways and chambers are formed by drilling.

6. In an engine combustion system having a plurality of combustion chambers, each combustion chamber having an intake valve, an exhaust valve and a fuel injector, the improvement comprising:

a plurality of discrete, separate control modules each being connectible to a respective one of said intake valve, exhaust valve, and fuel injector of a respective engine cylinder and connectable to one another in fluid communication via a high pressure major passageway, each of said control modules having a housing having three actuator cavities, three valve cavities, three high pressure intake passageways, three high pressure delivery passageways;

each of said actuator cavities being adapted to receive an actuator in communication with the respective valve cavity;

each of said valve cavities adapted to receive an "on-off" valve;

each of said high pressure intake passageways being in fluid communication with the high pressure major passageway and a respective valve cavity; and each of said high pressure delivery passageways being in fluid communication with a respective valve cavity and, in the installed position, a respective one of hte intake valve, exhaust valve and fuel injector.

7. An engine combustion system, as set forth in claim 6, wherein said actuator cavities and associated valve cavities are generally parallel to the other actuator cavities and associated valve cavities and traverse a longitudinal axis of said combustion chamber in the installed position.

8. The engine combustion system of claim 6, at least a portion of at least one of said high pressure delivery passageways being formed at a compound angle.

9. The engine combustion system of claim 2, wherein at least a portion of said passages are formed at a compound angle.

* * * * *

UNITED STATES PATENT AND TRADEMARK OFFICE

CERTIFICATE OF CORRECTION

PATENT NO. : 5,237,976

DATED : August 24, 1993

INVENTOR(S) : Keith E. Lawrence, Tsu P. Shyu

It is certified that error appears in the above-identified patent and that said Letters Patent is hereby corrected as shown below:

In claim 6, column 8, line 17, "connectible" should be --connectable-- ;

In claim 6, column 8, line 38, "hte" should be --the-- .

Signed and Sealed this

Sixteenth Day of August, 1994

*Attest:*

*Attesting Officer*

BRUCE LEHMAN

*Commissioner of Patents and Trademarks*